United States Patent [19]

Bianchi

[11] Patent Number: 4,667,374

[45] Date of Patent: May 26, 1987

[54] HOLSTER CLIP

[75] Inventor: John E. Bianchi, Temecula, Calif.

[73] Assignee: Bianchi International, Temecula, Calif.

[21] Appl. No.: 327,578

[22] Filed: Dec. 4, 1981

[51] Int. Cl.[4] ..... A44B 21/00; A45F 5/02

[52] U.S. Cl. ..... 24/3 J; 224/252; 224/253; 224/911

[58] Field of Search ..... 24/3 J, 6, 3 F; 224/911, 912, 192, 193, 194, 195, 252, 253

[56] References Cited

U.S. PATENT DOCUMENTS

| | | | |
|---|---|---|---|
| 2,589,126 | 3/1952 | Payne | 224/253 |
| 3,250,448 | 5/1966 | Clark | 224/252 |
| 3,300,109 | 1/1967 | Clark | 224/911 |
| 3,326,433 | 6/1967 | Koch | 224/252 |
| 3,353,728 | 11/1967 | Freed | 224/253 |
| 3,379,349 | 4/1968 | Hier | 224/253 |
| 3,642,183 | 2/1972 | Boren | 224/253 |
| 3,992,776 | 11/1976 | Koppe et al. | 224/253 |
| 4,044,930 | 8/1977 | Petroski | 224/252 |
| 4,148,422 | 4/1979 | Habler | 224/252 |
| 4,358,036 | 11/1982 | Maltais | 224/252 |

*Primary Examiner*—Gene Mancene
*Assistant Examiner*—J. Hakomaki
*Attorney, Agent, or Firm*—John E. Wagner

[57] ABSTRACT

A holster clip 10 having a recess 46 on one leg 22 whereby a portion of the wearer's belt 18 is deflected into the recess by the opposite clip leg 20, anchoring the clip and its associated holster and weapon to the belt against inadvertent dislodgement.

10 Claims, 4 Drawing Figures

HOLSTER CLIP

TECHNICAL FIELD

This invention has to do with clips for the support of gun holsters at the waist of a user, and more particularly to improvements in gun holster clips of the type used to support concealed holsters inside the waistband of trousers.

BACKGROUND ART

It is known to wear concealed holsters within the trousers or skirt, supported at the waistband by a clip which straddles the waistband and the belt which encircles the waistband and provides the main support for the holster. The holster typically is a soft leather pouch but may be made of any of various materials. A structure, suitably formed of leather panels of greater rigidity and strength than the pouch portion of the holster is sewn or otherwise fastened to the pouch to provide an anchor for the clip.

Known holster clips are formed of spring steel into generally a U-shape, providing legs mutually biased toward each other for pinching the waistband and belt between them. The clip legs, being typically planar, smooth-surfaced members may tend to slide along the belt and waistband, mislocating the holster. Because only moments may available for a law enforcement officer to draw his gun, mislocation of the weapon is a dangerous condition.

DESCRIPTION OF THE INVENTION

It is therefore an object of the invention to provide an improved holster support clip. More particularly, it is an object to provide a holster support clip which positively prevents mislocation by slippage or sliding along the waistband. Another object is to provide a holster clip which is economical to manufacture, attractive, and more effective in use than previously known holster clips.

These and other objects of the invention to become apparent hereinafter are realized, in accordance with the invention, by the provision in a clip for securing a holster to a waistband and a waistband-encircling belt, comprising a spring member bent to a generally U-shape to have parallel, generally planar legs mutually biased toward engagement across the waistband and belt, the legs including a first, inner leg having a planar face adapted to engage the inward face of the waistband and a second, outer leg having a planar face adapted to engage the outward face of the belt, and cooperating means carried by the legs to maintain a predetermined leg spacing such that the legs pinch the belt and waistband therebetween, of the improvement comprising the outer leg face being locally surface discontinuous in pinched belt portion receiving relation, in a manner that the received belt portion blocks relative sliding of the clip and the belt in the holster securing condition of the clip.

In particular embodiments, the clip is formed of spring metal; the cooperating spacing means comprise terminal opposed deflections of the legs; and the outer leg face is centrally locally surface discontinuous.

The invention further contemplates the foregoing clip in combination with a holster adapted to be carried by the clip.

In particularly preferred embodiments, the clip outer leg is centrally recessed, e.g. circularly, to define a local surface discontinuity opposite the belt of depth relative to the predetermined spacing of the legs to be adapted to receive the belt in pinching force relieving relation and block relative sliding of the clip and the belt.

In this, as in other embodiments above, the clip typically is formed of spring metal, and the cooperating spacing means comprise terminal opposed deflections of the legs. Further, the inner leg defines a shank above the terminal deflection, the shank being adapted to interfit with a holster mounting structure, and the invention comtemplates the clip in combination with a holster having a holster mounting structure adapted to be carried by the clip at the inner leg shank.

THE DRAWINGS

The invention will be further described as to an illustrative embodiment in conjunction with the attached drawings in which.

PREFERRED MODES

Figure 1:
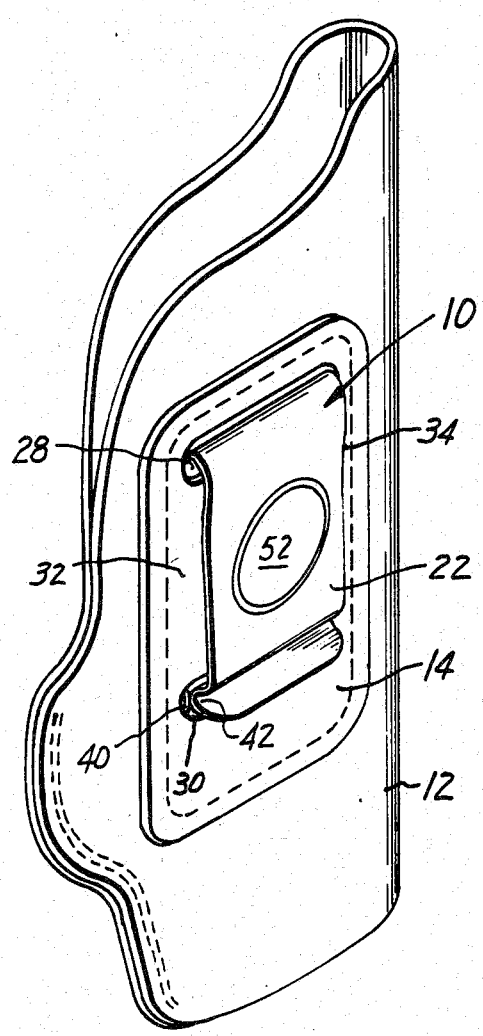
FIG. 1 is a perspective view of the clip in combination with a holster.
Figure 2:
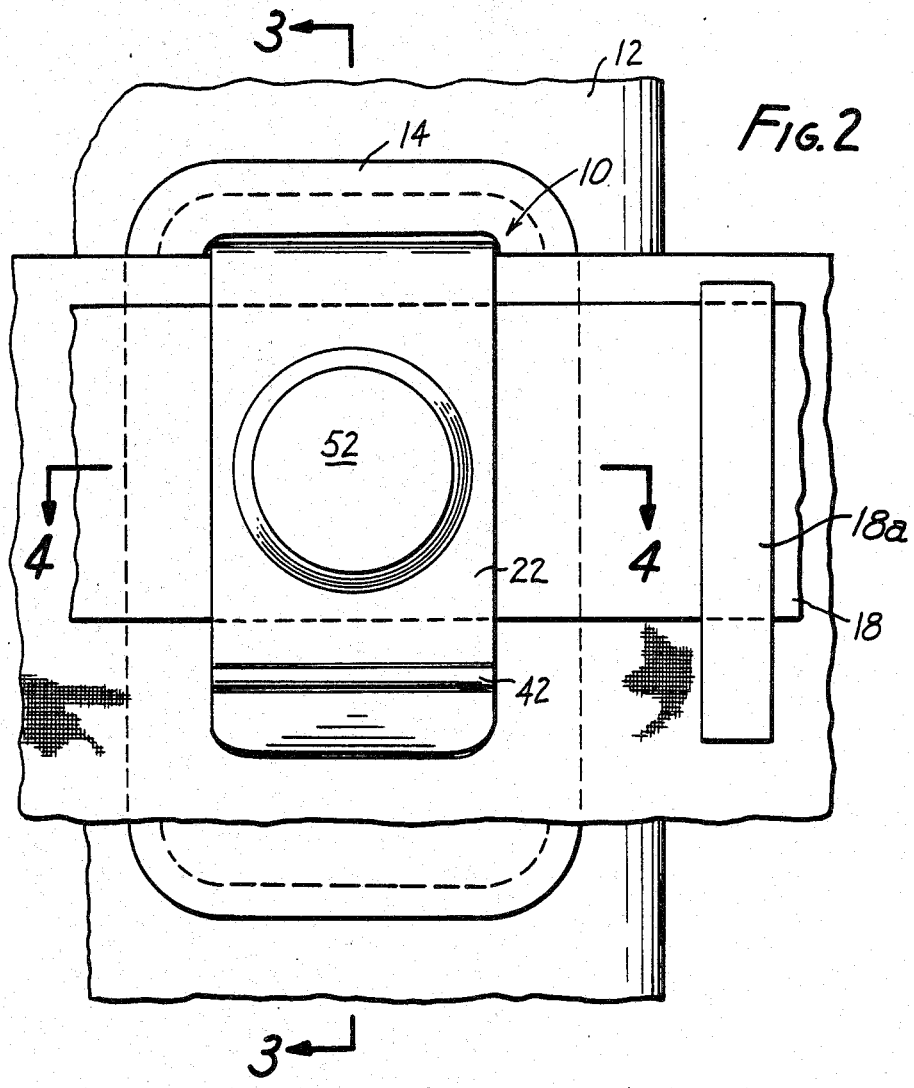
FIG. 2 is front elevation view of the clip and holster in mounted condition.

Turning now the drawings in detail, initially with particular reference to FIG. 1, the invention clip is depicted generally at 10 secured to holster 12 by interfittment with stiff leather panel 14 sewn to the holster and defining a clip mounting structure. As shown in FIG. 2, the clip 10 snaps onto the upper edge of a waistband 16, belt 18 combination, holster within the trouser top defined by the waistband, with the inner leg 20 of the clip pressed against the inside face 24 of the structure panel 14, and the outer leg 22 of the clip pressed against the outer face 26 of the belt 18, the belt encircling the wearer's waist, through belt loops **18*a*, and providing most of the support for the holster 12**, and gun carried (not shown).

The support structure panel 14 has upper and lower slots 28, 30 and land 32 therebetween, so that the inner leg 20 of the clip 10 may be passed behind the panel as shown.

Figure 3:
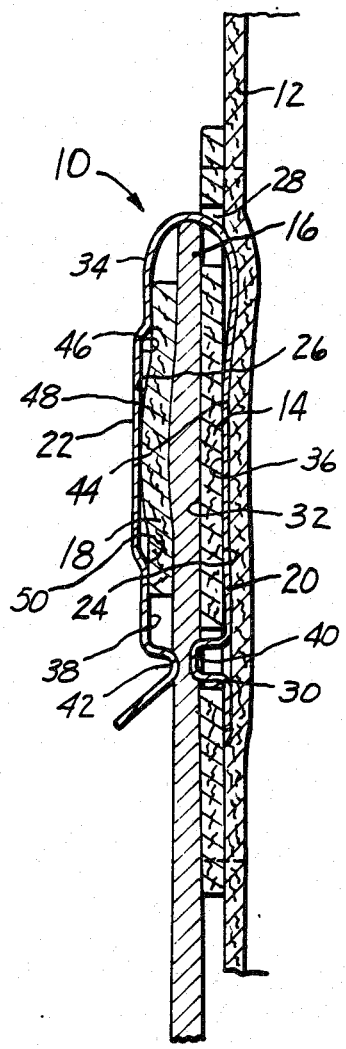
FIG. 3 is a longitudinal sectional view of the clip mounting a holster to a belt-encircled waistband, taken at line 3—3 in FIG. 2.

The clip 10 is comprised of an elongated, flat, spring metal member 34 bent on itself to a general U-shape, as shown, to have parallel, generally planar inner and outer legs 20 and 22, respectively, best shown in FIG. 3. The clip member inner and outer legs 20, 22 are generally rectangular in longitudinal and transverse cross-section, see FIG. 4, and have opposed rectangular faces 36, 38, respectively. The clip member inner and outer legs 20, 22 are so formed of suitable spring metal and so shaped as to be resiliently biased toward engagement with each other across the land 32 of the holster mounting panel 14, waistband 16 and the belt 18. The downward terminations of the clip member 18 legs are deflected as best shown in FIG. 3, to form a rectangular boss 40 at the inner leg 20 terminus, and a generally V-shaped boss 42 at the outer leg 22 terminus, both as viewed in cross section, and opposite one another. The deflection bosses 40, 42 are normally in contact unless displaced by intervening material such as waistband 16. Bosses 40, 42 limit the minimun proximity of legs 20, 22, and thus by their shape and size predetermine the spacing of these legs. The predetermined spacing of legs 20, 22 is such that when the clip member 18 is worn, the combined thickness of panel 14, waistband 16 and belt 18 is greater than the predetermined spacing, whereby the legs squeeze and pinch upon the material between them.

Additionally, the inner leg 20 shank is slightly convex, at 44, toward the outer leg 22, and centrally of the leg 20 length to somewhat outwardly deflect and better engage the face 24 of panel 14, again as best shown in FIG. 3.

The present invention is concerned with improvements enabling more secure positioning of a holster clip on a wasitband and belt. In use, a concealed holster must be kept at an optimum location for ready use. Sliding and slippage of the holster, and the gun therewithin, relative to the waistband 16, despite the mutual leg 20, 22 pinching effect described above, may mean mislocation of the holster and loss of critical seconds in drawing the weapon from the holster, or even disassociation of the holster from the waistband altogether during violent activity.

Figure 4:
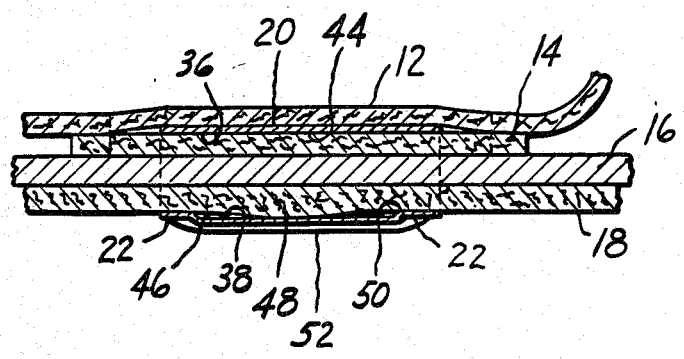
FIG. 4 is a horizontal sectional view thereof, taken at line 4—4 in FIG. 2.

The present invention provides, therefore, an improvement in holster clips which positively secures the clip, and thus the holster and gun therein, to a desired location along the waistband and belt of the wearer. In general, and with reference to FIGS. 1–4, the positive securement feature of the improved clip of the invention comprises provision, in the outer leg 22, and generally opposite the convex portion 44 of the inner leg 20, so as to be generally coincident therewith, of a localized surface discontinuity, illustrated as a relief or recess 46, formed in the outer leg 22. The location, e.g. centrally of the leg 22, the shape, e.g. circular, and the size, e.g. approximately in width 75% or more of the width of the outer leg 22, and in depth 100% to 200% of the thickness of the leg 22, which depth extends below the plane of the leg face 22, are to be determined in particular cases, but in all cases are such that the belt 18 is positively deflected into the relief aperture or recess 46 by the effect of the inner leg 20 convex portion 44 pressing resiliently against the panel land 32 under the force of the spring metal of element 18, toward outer leg 22, across the waistband 16 and belt 18. The belt portion 48 opposite the relieved area 46 distends outward since it is unsupported, unlike the immediately surrounding portions of the belt, but like such portions subject to the pressing or pinching between the legs 20, 22. The distention is shown in FIGS. 3 and 4, somewhat exaggerated for clarity of illustration. A circular lip, and an inverted dome shape is preferred in recess 46, and as well one with gently sloping sides and optimally with a ridge around the recess raised from the plane of the leg surface, to further enhance the pressures on the belt in the region of the recess and heighten the contrast between the supported and unsupported portions of the belt.

In practice, the displaced belt portion 48 becomes a flexible boss which binds at the edges 50 of the recess 46 as the belt and clip 10 move relatively. The protrusion of the belt portion 48 serves to anchor the clip 10 where it is, and against dislodgement up or sideways.

The discontinuity need not be a recess like 46 having a bottom wall. It is preferred however, to have a gently rounded slope-sided recess like recess 46 shown, which is conveniently formed in the outer leg 22 by conventional means prior to bending the spring metal on itself. The obverse face 52 of the recess 46 is conveniently used for display of a logo.

The predetermined spacing of the legs 20, 22 noted above will affect the degree of pinching of the belt, along with such factors as the thickness of the waistband 16, and the thickness of the panel land 32. The greater the pinching force derived from these factors, the greater the potential displacement of the belt portion 48 into the recess 46. The convex portion 44 of the inner leg of course enhances the pinching and displacement effect when the recess 46 is thereopposite. Additionally, the presence of the recess across substantially the width of the clip leg 22 rigidifies this leg against unwanted flexing under stress, in both the transverse and longitudinal direction.

The improved clip of the present invention thus achieves the above mentioned objectives of positively preventing mislocation of the holster 12 by slippage or sliding along the waistband 16 and of providing an economical, attractive and more effective holster clip than has previously been known.

I claim:

1. In a clip for securing a holster to a waistband and a waistband-encircling belt, comprising a spring member bent to a generally U-shaped to have parallel, generally planar legs mutually biased toward engagement across said waistband and belt, said legs including a first, inner leg having a planar face engaging the inward face of said waistband and a second, outer leg having a planar face engaging the outward face of said belt, and cooperating means carried by said legs to maintain a predetermined leg spacing such that said legs pinch said belt and waistband therebetween;

the improvement comprising said inner leg positively deflecting said belt outward, said outer leg being locally surface discontinuous by means of an outward convex distension of a section in the region of the belt whereby the under side of said convex distension is in deflected belt portion receiving relation, the received belt portion cooperating with said clip in blocking relative sliding movement of said clip and said belt in the holster securing condition of said clip.

2. The clip according to claim 1, in which said clip is formed of spring metal.

3. The clip according to claim 1, in which said cooperating spacing means comprise terminal opposed deflections of said legs.

4. The clip according to claim 1, in which said outer leg face is centrally locally surface discontinuous.

5. The clip according to claim 1, in combination with a holster adapted to be carried by said clip.

6. The clip according to claim 1, in which said outer leg is outwardly embossed in a central location and recess on the inner surface thereof to define a generally circular local surface discontinuity providing a recess across at least 75% of the width of said outer leg and opposite the deflected portion of said belt, said recess being of a depth relative to said predetermined spacing of said legs to be adapted to receive said belt deflected portion and to block relative sliding of said clip and said belt.

7. The clip according to claim 6, in which said clip is formed of spring metal.

8. The clip according to claim 7, in which said cooperating spacing means comprise terminal opposed deflections of said legs.

9. The clip according to claim 8, in which said inner leg defines a shank above said terminal deflection, said shank being adapted to interfit with a holster mounting structure.

10. The clip according to claim 9, in combination with a holster having a holster mounting structure adapted to be carried by said clip at said inner leg shank.

* * * * *